US005240113A

United States Patent [19]

Gibilisco

[11] Patent Number: 5,240,113

[45] Date of Patent: Aug. 31, 1993

[54] CHILD RESISTANT DRUG ASSEMBLAGE

[75] Inventor: Kenneth J. Gibilisco, Coopersburg, Pa.

[73] Assignee: Merck & Co., Inc., Rahway, N.J.

[21] Appl. No.: 961,590

[22] Filed: Oct. 15, 1992

[51] Int. Cl.[5] ..... A61J 1/03

[52] U.S. Cl. ..... 206/534; 206/538; 220/305; 220/256

[58] Field of Search ..... 206/538, 539, 535, 536, 206/534.1, 534.2, 534, 528, 807; 220/346, 305, 256; 215/216

[56] References Cited

U.S. PATENT DOCUMENTS

| | | | |
|---|---|---|---|
| 364,623 | 6/1887 | Beidler | 206/539 X |
| 2,383,367 | 4/1945 | Brown . | |
| 3,033,355 | 5/1962 | Van Sickle . | |
| 3,182,789 | 5/1965 | Sparks | 206/536 |
| 3,527,190 | 9/1970 | Huck | 206/539 X |
| 3,833,143 | 9/1974 | Starkermann et al. . | |
| 3,888,350 | 6/1975 | Horvath . | |
| 4,038,937 | 8/1977 | Moe | 206/538 X |
| 4,062,445 | 12/1977 | Moe | 206/538 X |
| 4,169,531 | 10/1979 | Wood | 206/539 X |
| 4,593,819 | 6/1986 | Will | 206/538 |
| 4,817,819 | 4/1989 | Kelly . | |

*Primary Examiner*—Steven N. Meyers
*Assistant Examiner*—Jacob K. Ackun, Jr.
*Attorney, Agent, or Firm*—Frank P. Grassler; Charles M. Caruso

[57] ABSTRACT

A child resistant drug assemblage is disclosed comprising a container having rows of spaced drug cell cavities each of which receives a unit drug dose of medication. The container is provided with a lock means that enables it to be readily opened by an adult but difficult to be opened by a child.

2 Claims, 2 Drawing Sheets

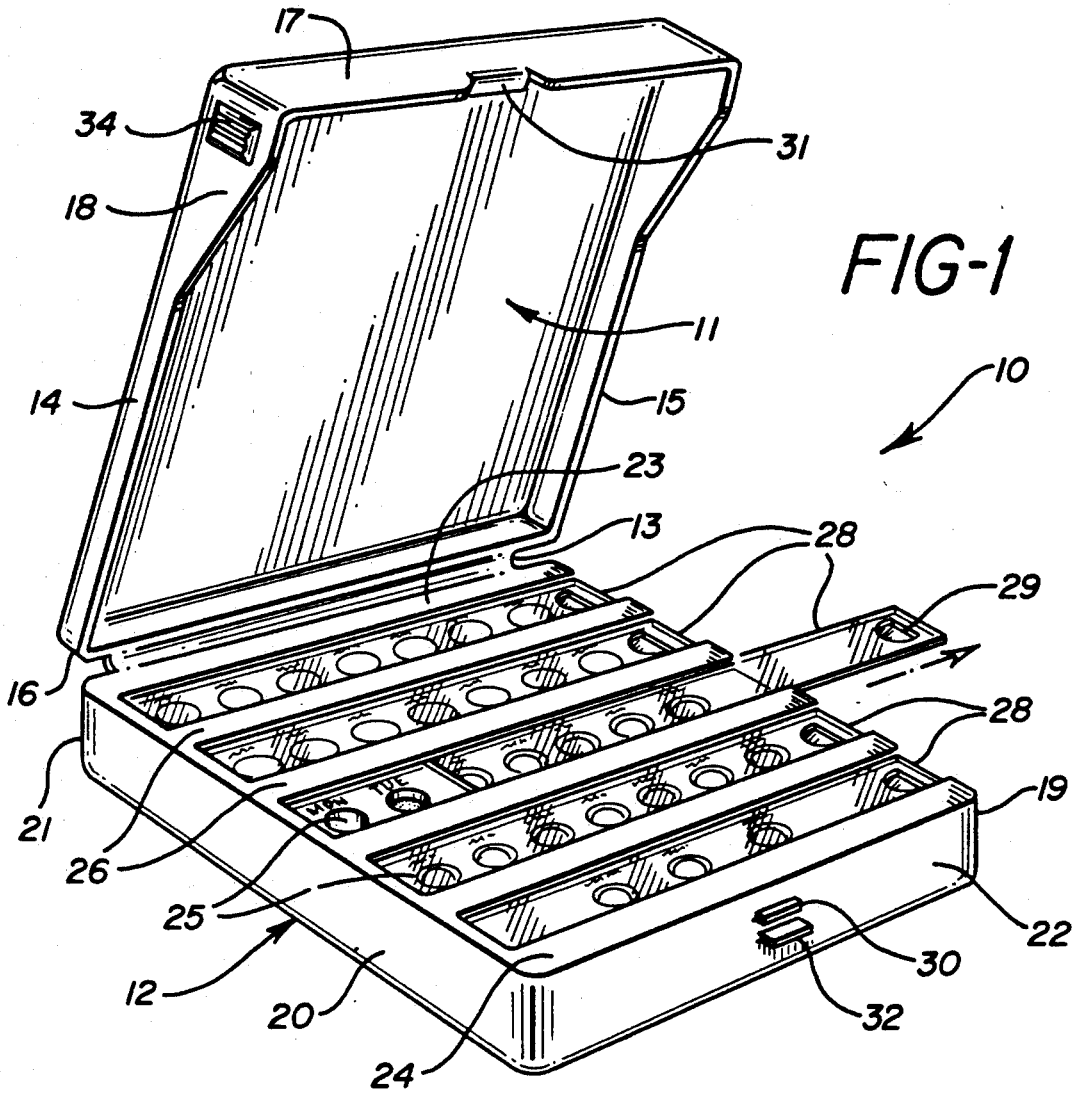
FIG-1
FIG-2
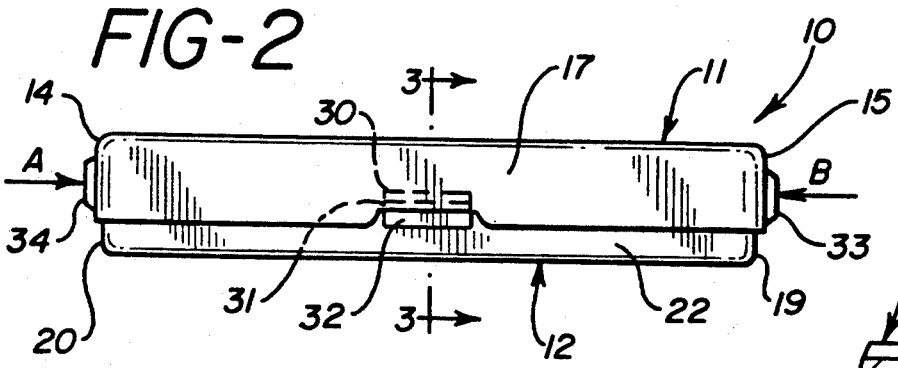
FIG-3
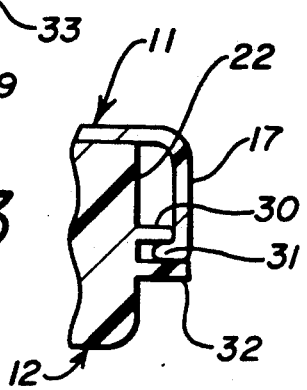

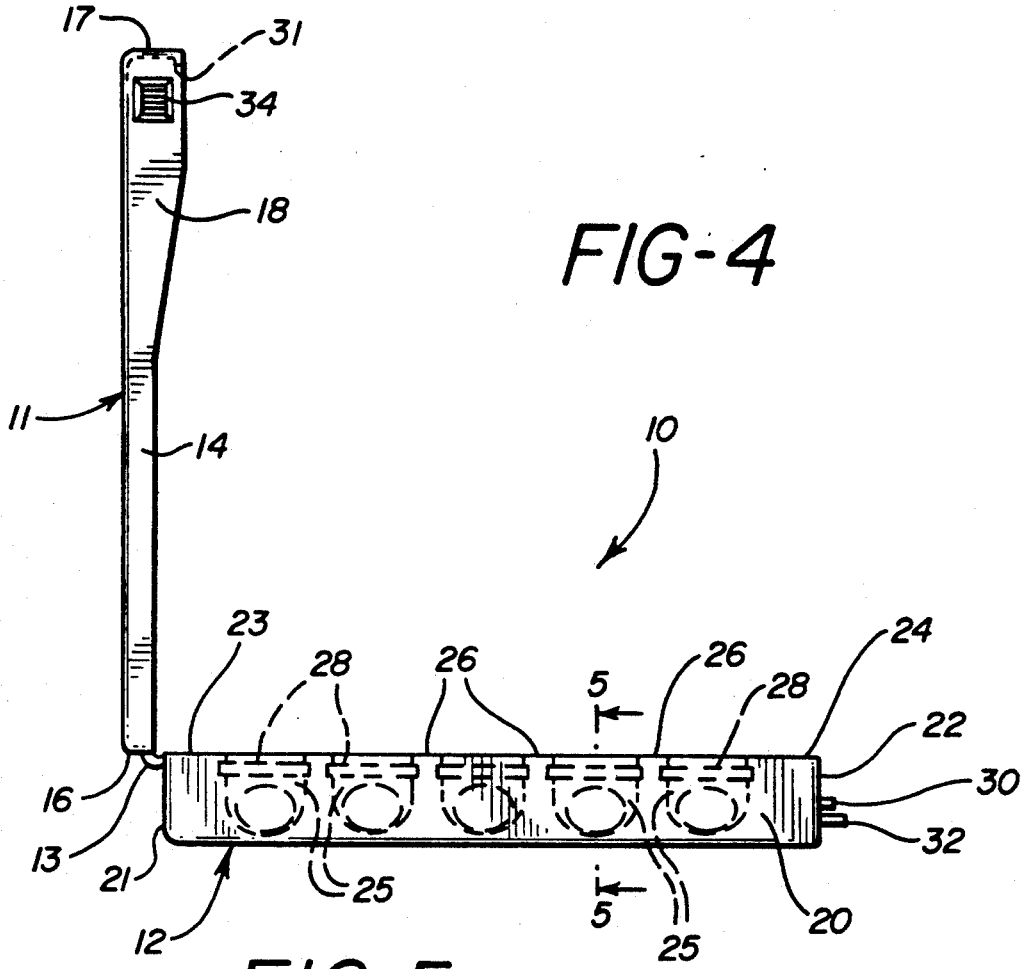
FIG-4
FIG-5
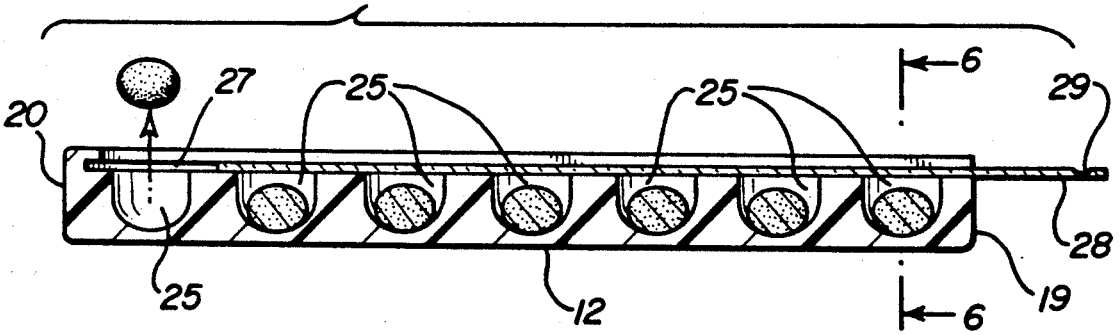
FIG-6
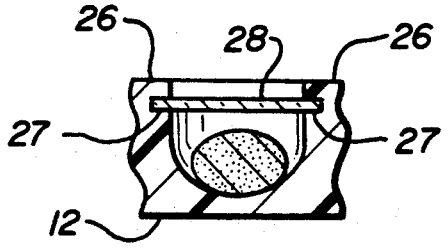

CHILD RESISTANT DRUG ASSEMBLAGE

BACKGROUND OF THE INVENTION

Many medications are dangerous if taken by children or if taken by children in excess. In order to prevent accidental ingestion of medications by children who encounter a medication container, it has been desirable to design medication containers that are resistant to being opened by children.

It has also been desirable to provide medication containers that are simple and easy to use to improve patient compliance.

SUMMARY OF THE INVENTION

In general, the child resistant drug assemblage of the invention comprises a container having a cover hingeably secured to a compartment section, the compartment section having a plurality of spaced drug cell cavities arranged in rows, each drug cell cavity receiving a unit drug dose of medication; lock means to secure said cover to said compartment section; and, a slidably removable top cover to overly said drug cell cavities.

In a preferred embodiment, the lock means is a snap-lock assemblage which can be readily disengaged by an adult when manual pressure is appropriately applied to the cover; and, indicia can be provided on the removable top cover in association with each drug cell cavity to identify a day of the week.

DETAILED DESCRIPTION OF THE INVENTION

The child resistant drug assemblage of the invention will be better understood and preferred embodiments thereof will become more apparent from the ensuing description when considered together with the accompanying drawing wherein like reference numerals denote like parts and wherein:

FIG. 1 is a perspective view of the drug assemblage of the invention showing the child resistant container, the separate unit drug dose cells, and a top cover;

FIG. 2 is a front end view of the container of FIG. 1 illustrated in a closed position;

FIG. 3 is an enlarged sectional view taken substantially on line 3—3 of FIG. 2 illustrating details of a locking means;

FIG. 4 is a side view of the open container shown in FIG. 1 in a normally closed position;

FIG. 5 is a sectional view taken substantially on line 5—5 of FIG. 4 illustrating details of the slidably removable cover; and, FIG. 6 is a sectional view taken substantially on line 6—6 of FIG. 5.

As illustrated in FIG. 1, the child resistant container of the invention comprises a container, generally indicated by reference numeral 10, having a cover 11 and a compartment section 12 which are hingeably secured to one another by conventional hinge means 13 (FIG. 4).

As shown in FIGS. 1-4, cover 11 has opposed depending side walls 14, 15 a depending back wall 16 and an opposed, depending front wall 17. Preferably and as depicted in FIG. 4, the side walls 14, 15 of cover 11 are fabricated to have an enlarged tapered section 18 adjacent front wall 17.

Compartment section 12 has opposed, upwardly projecting side walls 19, 20, an upwardly projecting back wall 21 and an opposed upwardly projecting front wall 22. Preferably, back wall 21 and front wall 22 have inwardly extending thickened sections 23, and 24, respectively (FIG. 1). Formed in the interior body of compartment section 12 are a plurality of spaced drug cell cavities 25 which are arranged in equally spaced rows. Preferably, each row contains seven cavities, one for each day of the week, with a fifth row containing at least three drug cell cavities all as clearly shown in FIG. 1. Thus, a sufficient number of drug cell cavities 25 are provided to accommodate a month's supply of unit drug doses of medication.

The upper planar surface of each row of drug cell cavities 25 is recessed within the body of compartment section 12 to form a plurality of spaced ribs 26 which extend transversely across compartment section between opposed side walls 19 and 20.

As shown more clearly in FIGS. 5 and 6, ribs 26 as well as thickened sections 23 and 24 have grooves 27 formed therein adjacent their upper planar surfaces which extend from one side wall 20 to and through opposed side wall 19. Grooves 27 serve to receive slidably removable top cover 28 (FIGS. 1, 5 and 6) which overlays the drug cell cavities 25 and retains and protects unit drug doses placed in the drug cell cavities 25.

When unit doses of medication in cells 25 are to be accessed, top cover 28 can be slid along grooves 27 to expose one or more cells 25 as illustrated in FIGS. 1 and 5. To facilitate sliding top cover 28 in grooves 27, a finger tip notch 29 can be provided at that end of the top cover 28 where grooves 27 extend through side wall 19 as shown in FIGS. 1 and 5.

As clearly shown in FIGS. 1 and 4, cover 11 and compartment section 12 are hingeably secured to each other by hinge means 13 at their common back walls 16 and 21. In addition, cover 11 is sized so that its side walls 14, 15 and front wall 17 overlap side walls 19, 20 and front wall 22 of compartment section 12 when closed and lockably secured to each other.

One means to lockably secure cover 11 and compartment section 12 to each other when closed is illustrated in FIGS. 3 and 4 wherein the outer face of the front wall 22 of the container section is provided with an outward projection 30 intermediate its height and the inner face of the front wall 17 of the cover is provided with an inwardly projecting lip 31 positioned to engage outward projection 30 in a snap-locking assemblage. To prevent cover 11 from being pressed downwardly too severely when snap-locking cover 11 and compartment section 12 together, a stop detent 32 in the form of an elongated outward projection can be provided beneath and spaced from projection 30 as shown in FIGS. 2 and 3.

In order to facilitate disengagement of the snap-lock assemblage; i.e., disengage lip 31 from projection 30, cover 11 can be grasped at predesignated points 33 and 34 located on opposed side walls 14, 15 (FIG. 2) and inward pressure can be manually exerted by an adult with the fingers of one hand at these points toward the center of cover 11 as indicated by arrows A and B. The inward pressure causes front wall 17 of cover 11 to flex outwardly causing lip 31 to become disengaged from projection 30 whereupon cover 11 can be rotated upwardly by finger tip pressure of the other hand enabling the contents of container section 12 to be accessed. Thus, cover 11 can be readily grasped by an adult in one hand to apply the squeezing pressure necessary to facilitate disengaging the snap-lock assemblage while rotating the cover to its open position with the other hand. It would be difficult for a child to imitate the same manual manipulations as a child's hand will not normally be large enough to span the cover and apply the necessary squeezing pressure.

To enhance patient compliance, appropriate indicia can be printed adjacent each of the drug cells cavities 25 such as the name of each day in the week as illustrated in FIG. 1.

The drug cells 25 should be sized to hold at least one unit dose of a drug regardless of the form of the drug; i.e., tablet, capsule, caplet, or the like. In addition, the drug cells can be sized to accommodate two or more unit doses of a drug when multiple daily doses of a drug are prescribed.

The child resistant drug assemblage of the invention can ba made of any suitable materials but moldable plastic is preferred. Polyethylene, either low or high density, can be used as can polypropylene. For cost considerations, low density polyethylene is preferred.

Although the child resistant drug assemblage of the invention has been described with particularity and in detail, it will be apparent to those skilled in this art that modifications can be made therein without departing from the scope of the invention defined in the claims.

What is claimed is:

1. A child resistant drug assemblage comprising:

(a) a cover having an upper planar surface, opposed depending side walls having inner and outer surfaces, a depending back wall having inner and outer surfaces and an opposed depending front wall having inner and outer surfaces;

(b) a compartment section having a body defined by an upper planar surface and a lower planar surface, opposed upwardly projecting side walls having inner and outer surfaces, an upwardly projecting back wall having inner and outer surfaces and an opposed upwardly projecting front wall having inner and outer surfaces, said opposed depending side walls, depending back wall and opposed depending side walls, depending back wall and opposed depending front wall of said cover being sized to overlap said opposed, upwardly projecting side walls and opposed upwardly projecting of said compartment section when said child resistant drug assemblage is closed;

(c) means to hingeably secure said depending back wall of said cover to said upwardly projecting back wall of said compartment section, said means juxtaposed between said depending back wall of said cover and said upwardly projecting back wall of said compartment section;

(d) cooperating means on said outer surface of said opposed upwardly projecting front wall of said compartment section and on said inner surface of said opposed depending front wall of said cover to snap-lock said cover to said compartment section;

(e) a plurality of spaced drug cell cavities formed within said upper planar surface of said body of said compartment section and arranged in a plurality of equally spaced rows to provide at least five of said rows, at least a plurality of said rows containing at least seven of said cavities, said upper planar surface being recessed within said compartment section body to form a plurality of spaced ribs having spaced rib side walls, each of said spaced ribs being juxtaposed between two of said drug cell cavity rows, and which spaced ribs extend transversely across said compartment section between said upwardly projecting opposed side walls of said compartment section, each side wall of said spaced ribs and said inner faces of said upwardly projecting back and opposedly upwardly projecting front walls of said compartment section having a groove formed therein adjacent said upper planar surface, said grooves extending from said inner surface of one upwardly projecting side wall of said compartment section to and through an opposed upwardly projecting side wall of said compartment section; and, (f) a plurality of top closures each of which is capable of being slidably received in opposed, adjacent pairs of said grooves to overly said drug cell cavities in each of said rows.

2. The child resistant drug assemblage of claim 1 wherein indicia are imprinted adjacent each of said drug cell cavities in each of said rows to identify a day of the week.

* * * * *